US010050418B2

(12) United States Patent
Marrs

(10) Patent No.: US 10,050,418 B2
(45) Date of Patent: Aug. 14, 2018

(54) IGNITION COIL FOR PASSING ALTERNATING CURRENT TO A SPARK PLUG

(71) Applicant: MARSHALL ELECTRIC CORP., Rochester, IN (US)

(72) Inventor: Thomas C. Marrs, Rochester, IN (US)

(73) Assignee: MARSHALL ELECTRIC CORP., Rochester, IN (US)

( * ) Notice: Subject to any disclaimer, the term of this patent is extended or adjusted under 35 U.S.C. 154(b) by 427 days.

(21) Appl. No.: 14/851,267

(22) Filed: Sep. 11, 2015

(65) Prior Publication Data

US 2017/0077683 A1 Mar. 16, 2017

(51) Int. Cl.
*H01T 15/00* (2006.01)
*F02P 3/02* (2006.01)

(52) U.S. Cl.
CPC ..... *H01T 15/00* (2013.01); *F02P 3/02* (2013.01)

(58) Field of Classification Search
CPC .. H01F 5/00; H01F 38/12; H01T 15/00; F02P 3/02
USPC ..... 123/634, 146.5 R; 335/92, 222
See application file for complete search history.

(56) References Cited

U.S. PATENT DOCUMENTS 4,095,564 A * 6/1978 Hochstein ..... F02B 53/12 123/211
4,820,957 A * 4/1989 Zivkovich ..... F02P 3/01 123/607
5,692,482 A * 12/1997 Shimizu ..... F02P 3/02 123/634
5,947,093 A * 9/1999 Ward ..... F02P 3/04 123/169 EL
6,215,385 B1 * 4/2001 Ogden ..... H01F 38/12 123/634
6,328,025 B1 * 12/2001 Marrs ..... F02P 3/02 123/621
6,545,415 B1 * 4/2003 Ward ..... F02P 3/02 123/604
6,666,196 B2 * 12/2003 Skinner ..... F02P 3/0435 123/645
2003/0084889 A1 * 5/2003 Skinner ..... F02P 3/02 123/609
2004/0231652 A1 * 11/2004 Kondo ..... H01F 38/12 123/634
2009/0188458 A1 * 7/2009 Visser ..... F02D 35/021 123/169 R
2011/0074532 A1 * 3/2011 Cheng ..... H01F 1/37 336/83

(Continued)

*Primary Examiner* — Hieu T Vo
*Assistant Examiner* — Arnold Castro
(74) *Attorney, Agent, or Firm* — Egbert Law Offices, PLLC

(57) ABSTRACT

An ignition coil has a core with a longitudinal axis, a secondary winding extending around the core, a sleeve extending around the core, a primary winding wrapped around the sleeve, and a controller connected to the primary winding so as to oscillate alternating current to said primary winding. The secondary winding has a high-voltage end and a low-voltage end. The primary winding is in spaced longitudinal relationship from the secondary winding. Specifically, the primary winding is located longitudinally away from the high-voltage end of the secondary winding. A bobbin is positioned over and around the core. The secondary winding is wrapped around at least a portion of the bobbin.

15 Claims, 3 Drawing Sheets

(56) References Cited

U.S. PATENT DOCUMENTS

2013/0301306 A1* 11/2013 Hosotani ..... H02M 3/338
363/21.02

* cited by examiner

IGNITION COIL FOR PASSING ALTERNATING CURRENT TO A SPARK PLUG

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to ignition coils. More particularly, the present invention relates to ignition coils for delivering alternating current to a spark plug. In particular, the present invention relates to spark plugs in which the primary winding is spaced longitudinally away from a high-voltage end of the secondary winding.

2. Description of Related Art Including Information Disclosed Under 37 CFR 1.97 and 37 CFR 1.98

Most internal combustion engines have some type of ignition circuit to generate a spark in the cylinder. The spark causes combustion of the fuel in the cylinder to drive the piston and the attached crankshaft. Typically, the engine includes a plurality of permanent magnets mounted on the flywheel of the engine and a charge coil mounted on the engine housing in the vicinity of the flywheel. As the flywheel rotates, the magnets pass the charge coil. A voltage is thereby generated on the charge coil, and this voltage is used to charge a high voltage capacitor. The high voltage charge on the capacitor is released to the ignition coil by way of a triggering circuit so as to cause a high voltage, short duration electrical spark to cross the spark gap of the spark plug and ignite the fuel in the cylinder. This type of ignition is called a capacitive discharge ignition.

The design of standard reciprocating internal combustion engines which use spark plugs and ignition coils to initiate combustion have, for years, utilized combustion chamber shapes and spark plug placements which were heavily influenced by the need to reliably initiate combustion using only a single short-duration spark of relatively low intensity. In recent years, however, increased emphasis has been placed on fuel efficiency, completeness of combustion, exhaust cleanliness and reduced variability in cycle-to-cycle combustion.

There has been a strong need to place the ignition coil as close as possible to the input terminal of the spark plug. Ultimately, it has been the desire of engine manufacturers to have separate ignition coils associated with each spark plug of the internal combustion engine. However, the ability to directly connect ignition coils to each of the spark plugs have been limited by the size of the ignition coil and the space available for such ignition coil within the engine compartment of the vehicle. Conventionally, in the past, if the ignition coils were of a very small size, then they would lack the necessary capacity to transform the voltage of the battery into sufficient spark generating energy. As such, there has been a need to produce an ignition coil with a driver that has a maximum power output in a package as small as possible.

Most internal combustion engines have some type of ignition circuit to generate a spark in the cylinder. The spark causes combustion of the fuel in the cylinder to drive the piston and the attached crankshaft. Typically, the engine includes a plurality of permanent magnets mounted on the flywheel of the engine and a charge coil mounted on the engine housing in the vicinity of the flywheel. As the flywheel rotates, the magnets pass the charge coil. A voltage is thereby generated on the charge coil, and this voltage is used to charge a high voltage capacitor. The high voltage charge on the capacitor is released to the ignition coil by way of a triggering circuit so as to cause a high voltage, short duration electrical spark to cross the spark gap of the spark plug and ignite the fuel in the cylinder. This type of ignition is called a capacitive discharge ignition.

The design of standard reciprocating internal combustion engines which use spark plugs and ignition coils to initiate combustion have, for years, utilized combustion chamber shapes and spark plug placements which were heavily influenced by the need to reliably initiate combustion using only a single short-duration spark of relatively low intensity. In recent years, however, increased emphasis has been placed on fuel efficiency, completeness of combustion, exhaust cleanliness and reduced variability in cycle-to-cycle combustion.

There has been a strong need to place the ignition coil as close as possible to the input terminal of the spark plug. Ultimately, it has been the desire of engine manufacturers to have separate ignition coils associated with each spark plug of the internal combustion engine. However, the ability to directly connect ignition coils to each of the spark plugs have been limited by the size of the ignition coil and the space available for such ignition coil within the engine compartment of the vehicle. Conventionally, in the past, if the ignition coils were of a very small size, then they would lack the necessary capacity to transform the voltage of the battery into sufficient spark generating energy. As such, there has been a need to produce an ignition coil with a driver that has a maximum power output in a package as small as possible.

The standard design of an ignition coil is to have one primary winding and one secondary winding both located on one leg of a laminated core. Typically, the primary wound winding is wound next to the laminated core and the secondary winding is placed over the primary winding. This is done because the primary winding would normally be of lower resistance so that the "mean length of turn" is at a minimum. The secondary winding over the primary winding gives the proper "coupling" and "leakage inductance" to give the required output voltage, voltage rise time, etc.

Typically, in conventional ignition coils, the direct-current from the battery is utilized for transmitting direct current to the spark plug. Unfortunately, because of the nature of direct current, the spark from the spark plug will occur in one direction during spark discharge. Over time, this can have the effect of degrading the electrodes of the spark plug. This can have the effect of degrading the spark gap between the inner end of the central electrode and one or more protuberances or structures attached to the inner end of the threaded shell that serve as the ground electrode. In the past, it has been found that by passing an alternating current to the spark plug, the discharge can alternate between the inner end of the central electrode and the ground electrode. As such, this alternating current approach to delivering the spark will reduce the degradation of the electrodes of the spark plug.

Recently, there has been extensive developments in direct injection engines. These direct injection engines are a variation of fuel injection employed in modern two-stroke and four-stroke gasoline engines. The fuel is highly pressurized and injected via common rail fuel line directly into the combustion chamber of each cylinder, as opposed to conventional multi-point fuel injection that injects fuel into the intake tract or cylinder port. The direct injection of fuel into the combustion chamber requires high-pressure injection. The major advantages of direct injection engines are increased fuel efficiency and high power output. Emissions levels can also be more accurately controlled with the direct injection systems. These gains are achieved by the precise control over the amount of fuel and injection timings that are varied according to the engine load. Engine speed is controlled by an engine management system which regulates fuel injection function and ignition timing, instead of having a throttle plate that restricts the incoming air supply.

In such direct injection engines, the spark will need a longer duration at maximum voltage in order to effectively burn the injected fuel. This is especially true for diesel engines that have been converted into natural gas engines. In such cases, the natural gas is injected into the cylinder. As such, a high-voltage spark with an extended duration is required to effectively ignite the natural gas. With conventional direct-current ignition coils, there is an initial high-voltage spark that quickly degrades. As such, a need has developed so as to provide an extended-duration high-voltage spark in order to achieve maximum fuel burn in such direct injection engines.

In the past, various technologies have occurred in which the ignition coil is placed directly on the spark plug. In certain circumstances, there are "pencil coils" that are fit directly into the spark plug well. Unfortunately, these pencil coils cannot produce enough energy of a sufficient duration for effectively firing fuels, such as natural gas. There are also plug top coils that are fitted to the top of the spark plug and directly act with the electrodes if the spark plug so as to provide the necessary spark.

During the winding of the secondary of the ignition coil, progressive windings have been used. With such progressive winding, the winding traverse must be long in order to spread out the voltage distribution (layer-to-layer). The normal coil design will limit the total traverse (i.e. length) of the secondary bobbin to one inch to one and one-half inches. The "pencil coil" design has a very small diameter (usually less than one inch) and a length of between four and six inches. This type of coil is mounted directly to the spark plug and is normally used in an overhead valve engine where the spark plugs are placed in a cylindrical hole. The coil is usually a very low energy (30 milliJoules or less). The primary is usually wound over the laminated core and the secondary winding is placed over the primary winding. The secondary winding is of a very small round diameter and a three inch winding traverse. Progressive winding eliminates bays and flanges associated with the bobbin. The winding is faster. The elimination of flanges means that there is no stopping or slowing of the winding process in order to change bays. Progressive winding eliminates the problem of wires hanging up on flanges and not falling to the bottom of the bay. This is a major problem with section bobbin coils since this creates a loop of wire that has the voltage stress of the entire section. Often, one cannot see the loop after winding. As such, the coil may pass all reliability and quality tests before it eventually fails in field operation. Another problem with the progressive winding is that the progressive winding may slip from its desired position on the bobbin during assembly. After the assembly is effectively potted, such progressive windings mail may fail to achieve the requisite energy requirements.

In conventional ignition coil designs, the secondary is placed directly over the primary in the ignition coil. A dielectric material must be used between the primary winding in the secondary winding. When very high voltages are utilized in alternating current ignition systems, this dielectric material can degrade rather quickly. As such, this can effectively limit the life of the ignition coil. As such, a need has developed so as to avoid the degradation of any dielectric material or avoid the high voltages between the primary winding in the secondary winding.

In the past, various patents have issued with respect to ignition coil configurations. In the past, various U.S. patents have been issued to various inventors relating to such ignition coil designs. For example, U.S. Pat. No. 5,806,504, issued on Sep. 15, 1998 to French et al., teaches an ignition circuit for an internal combustion engine in which the ignition circuit includes a transformer having a secondary winding for generating a spark and having a first and second primary windings. A capacitor is connected to the first primary winding to provide a high energy capacitive discharge voltage to the transformer. A voltage generator is connected to the second primary winding for generating an alternating current voltage. A control circuit is connected to the capacitor and to the voltage generator for providing control signals to discharge the high energy capacitive discharge voltage to the first primary winding and for providing control signals to the voltage generator so as to generate an alternative current voltage.

U.S. Pat. No. 4,998,526, issued on Mar. 12, 1991 to K. P. Gokhale teaches an alternating current ignition system. This system applies alternating current to the electrodes of a spark plug to maintain an arc at the electrode of a desired period of time. The amplitude of the arc current can be varied. The alternating current is developed by a DC-to-AC inverter that includes a transformer that has a center-tapped primary and a secondary that is connected to the spark plug. An arc is initiated at the spark plug by discharging a capacitor to one of the winding portions at the center-tapped primary. Alternatively, the energy stored in an inductor may be supplied to a primary winding portion to initiate an arc. The ignition system is powered by a controlled current source that receives input power from a source of direct voltage, such as a battery on the motor vehicle.

U.S. Pat. No. 2,462,491, issued on Feb. 22, 1949 to Elton C. Hallett, describes an ignition coil and filter shield assembly which shields and protects electric units comprising portions of the ignition system of combustion engines with particular reference to a metallic housing which completely encloses some of the units.

U.S. Pat. No. 2,485,241, issued on Oct. 18, 1949 to G. L. Lang, describes a radio-shielded unit which relates to shielding means adapted for use with starting units or the like for internal combustion engines and more particularly to new and improved means for shielding such units against radio noise leakage.

U.S. Pat. No. 2,675,415, issued on Apr. 13, 1954 to W. W. Cushman, describes a radio interference suppression means for engines which relates to means preventing radio interference and the like, due to the operation of the high tension ignition elements of internal combustion engines and the like.

U.S. Pat. No. 2,840,622, issued on Jun. 24, 1958 to C. S. Marsen, describes a shielded ignition coil which relates to electrical connections between high voltage components such as a spark coil and distributor of an internal combustion ignition system, and particularly, to electromagnetic shielding of such connections to prevent radio interference generated by the high tension current.

U.S. Pat. No. 3,048,704, issued on Aug. 7, 1962 to S. E. Estes, describes a coil shield which relates to shielding of electrical systems for internal combustion engines, and more particularly to a shield for an ignition coil.

U.S. Pat. No. 3,542,006, issued on Nov. 24, 1970 to Dusenberry et al., describes an internal combustion engine radio frequency radiation suppression ignition system, which combines a gap of a width which is greater than is currently normal between the rotating terminal and each stationary terminal of an internal combustion engine distributor with television-radio radiation suppression ignition cable and resistor type spark plugs.

U.S. Pat. No. 4,875,457, issued on Oct. 24, 1989 to A. O. Fitzner, describes an apparatus and method for protecting engine electronics from radio frequency interference which suppresses RFI effects on an electronic control module enclosed in a metal housing.

U.S. Pat. No. 5,181,498, issued on Jan. 26, 1993 to Koiwa et al., describes an ignition apparatus for an internal combustion engine which is able to reduce the generation of noise and energy loss due to wiring to a substantial extent.

U.S. Pat. No. 5,359,981, issued on Nov. 1, 1994 to Kwi-Ju Kim, describes an apparatus for preventing electro-magnetic wave noise from being radiated and conducted from the igniting device of a gasoline engine.

U.S. Pat. No. 5,615,659, issued on Apr. 1, 1997 to Morita et al., describes an ignition apparatus for an internal combustion engine.

The present inventor is the inventor on several prior patents related to ignition systems. In particular, U.S. Pat. No. 6,102,730, issued on Sep. 5, 2002 to the present inventor, shows an ignition system for an internal combustion engine having a transformer with a primary winding adapted to be connected to a power supply and a secondary winding adapted to be connected to a spark plug of the internal combustion engine. A controller is interconnected to the transformer so as to activate and deactivate the output of the transformer. The transformer serves to produce an output from the secondary winding having a frequency of between 1000 Hertz and 100,000 Hertz and a voltage of at least twenty kilovolts. The transformer produces an output of an alternating current having a high-voltage sine wave of at least 20 kilovolts. A voltage regulator is connected to the power supply and to the transformer so as to provide a constant DC voltage input to the transformer. The transformer produces power of a constant wattage from the output of the secondary winding during the activation by the controller.

U.S. Pat. No. 6,135,099, issued on Oct. 24, 2000 to the present inventor, shows an ignition system for an internal combustion engine having a transformer with the primary winding adapted to be connected to a power supply and a secondary winding adapted to be connected to a spark plug of the internal combustion engine. A controller is interconnected to the transformer so as to activate and deactivate the output of the transformer. A voltage regulator is connected to the power supply and to the transformer so as to provide a constant DC voltage input to the transformer. The transformer is connected to the spark plug and to the controller so as to produce an arc of controllable duration across an electrode of the spark plug. This duration is selected between 0.5 milliseconds and 4.0 milliseconds.

U.S. Pat. No. 6,328,025, issued on Dec. 11, 2001 to the present inventor, describes an ignition coil having a core with a first leg and a second leg, a first primary winding arranged over the first leg, a second primary winding arranged over the second leg, a first secondary winding arranged over the first primary winding, a second secondary winding arranged over the second primary winding, and a spark plug terminal electrically connected to one end of the second secondary winding. The first primary winding is connected in series to the second primary winding. The first secondary winding is connected in series to the second secondary winding. The cores are of a laminated steel construction. The first and second secondary windings are progressively wound in multiple layers over respective bobbins.

It is an object of the present invention to provide an ignition system that provides an arc of extended duration.

It is another object the present invention to provide an ignition system that is particularly adapted for use in association with natural gas engines and hybrid engines.

It is another object of the present invention to provide an ignition system that serves to spread the high-voltage over an extended period of time.

It is another object of the present invention to provide an ignition system that provides significant energy for the firing of the spark plugs.

It is another object the present invention to provide an ignition system in which the secondary winding will not slip during the manufacturing process.

It is another object of the present invention providing ignition system wherein the ignition system can achieve 50,000 volts.

It is another object of the present invention provide an ignition system which avoids dielectrics between the primary winding and the secondary winding.

It is another object of the present invention to provide an ignition system that provides a constant AC voltage across the spark plug electrodes.

It is another object of the present invention to provide an ignition system that avoids interference with radio frequencies and the operation of the radio within the vehicle.

It is another object of the present invention to provide an ignition system that avoids the deterioration of the spark plug.

It is still a further object of the present invention to provide an ignition system that can be used in conjunction with direct injection engines.

These and other objects and advantages of the present invention will become apparent from a reading of the attached specification and appended claims.

BRIEF SUMMARY OF THE INVENTION

The present invention is an ignition coil that comprises a core having a longitudinal axis, a secondary winding extending around the core, a sleeve extending over the core, a primary winding wrapped around the sleeve, and a controller connected to the primary winding so as to oscillate alternating current to the primary winding. The secondary winding has a low voltage end and a high-voltage end. The primary winding is in spaced longitudinal relationship from the low voltage end of the secondary winding and located away from the high-voltage end of the secondary winding.

In the present invention, the core is formed of a ferrite material. In particular, the core can be formed of powdered ferrite bonded with epoxy.

A bobbin is positioned around the core. The secondary winding is wrapped around at least a portion of the bobbin. The bobbin has a plurality of bays formed thereon. The secondary winding is received within this plurality of bays. The plurality of bays are formed adjacent to the high-voltage end of the secondary winding. In an embodiment of the present invention, the sleeve can be integral with the bobbin. The secondary winding, in the preferred embodiment, has approximately 7000 turns. The primary winding of the preferred embodiment has approximately six windings. The high-voltage end of the secondary winding is adapted to pass 50,000 volts.

The controller has a MOSFET connected to the primary winding. This MOSFET is adapted to oscillate the alternating current to the primary winding. The MOSFET passes the alternating current to the primary winding with a resonance of at least 30,000 Hertz and less than 100,000 Hertz. A power supply is connected to the controller. This power supply is a direct current power supply, such as a 12 volt or 24 volt battery. The controller converts the DC power to the oscillating AC power. The controller is affixed adjacent to an end of the core opposite the high-voltage end of the secondary winding. A socket is connected to the high-voltage end of the secondary winding. This socket is adapted to electrically connect with a terminal of a spark plug.

The present invention is also an ignition system that comprises a direct current power supply, a controller connected to the direct current power supply, a core having a longitudinal axis, a secondary winding extending around the core, a primary winding extending around the core so as to be in spaced longitudinal relationship from the secondary winding, and a spark plug connected to a high-voltage end of the secondary winding. The controller is connected the primary winding so as to convert the direct current from the direct current power supply into an oscillating alternating current power to the primary winding.

In the ignition system of the present invention, a sleeve overlies the core. The primary winding is wrapped around the sleeve. A bobbin is positioned around the core. The secondary winding is wound around a portion of the bobbin. In particular, the bobbin has a plurality of bays formed thereon. The secondary winding is received in this plurality of bays.

The controller has a MOSFET connected to the primary winding. This MOSFET is adapted to oscillate the alternating current to the primary winding. The MOSFET passes the alternating current to the primary winding with a resonance of at least 30,000 Hertz and less than 100,000 Hertz.

This foregoing Section is intended to describe, with particularity, the preferred embodiment of the present invention. It is understood that modifications to this preferred embodiment can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
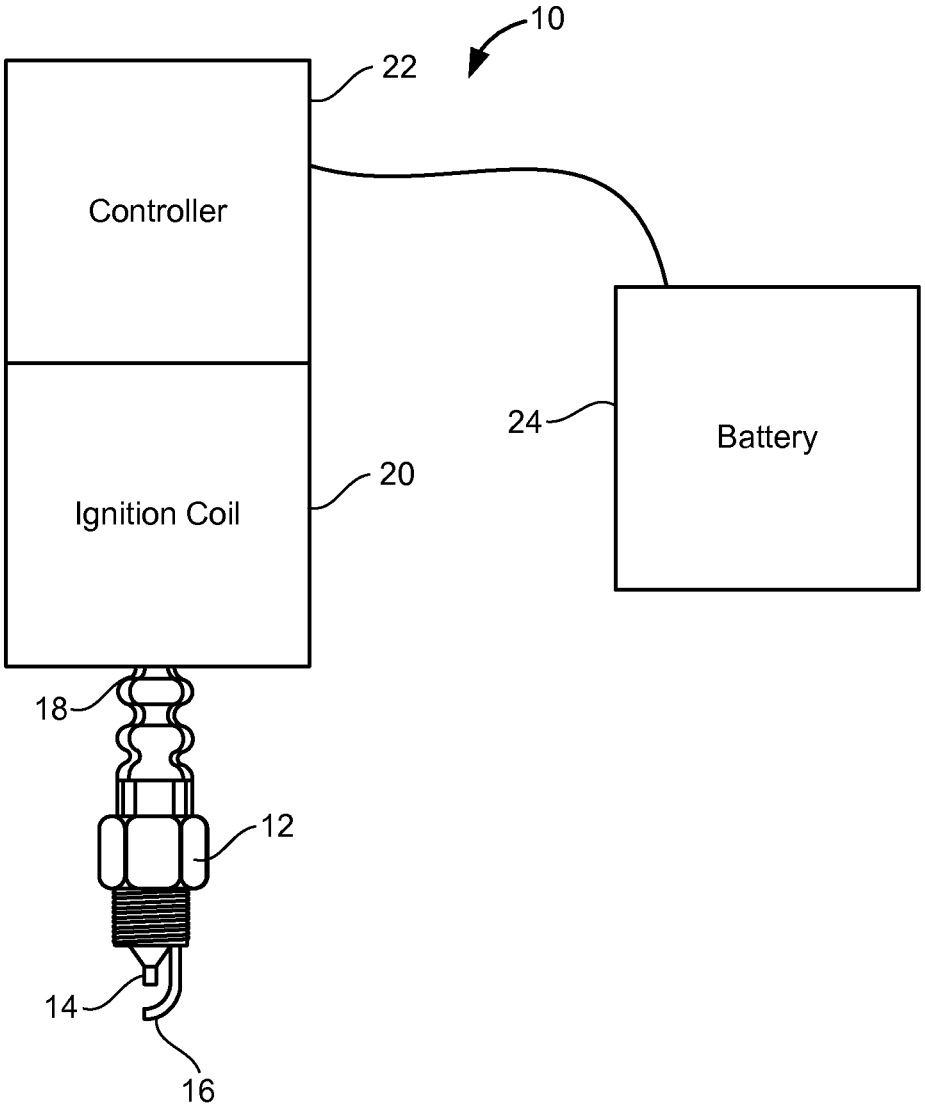
FIG. 1 is a diagram showing the ignition system in accordance with teachings of the present invention.

Referring to FIG. 1, there is shown a diagram showing the ignition system 10 of the present invention. The ignition system 10 includes a spark plug 12 having electrodes 14 and 16 at one end thereof. The spark plug 12 includes a terminal 18 at an end of the spark plug 12 opposite the electrodes 14 and 16. The ignition coil 20 of the present invention is directly amounted upon the terminal 18 of the spark plug 12. A controller 22 is positioned at the top of the ignition coil 20 and connected to the ignition coil 20 so as to control the firing of the ignition coil and, as a result, the firing of spark plug 12 such that a spark is generated between the electrodes 14 and 16. A battery 24 is connected to the controller 22 so as to supply direct current to the controller 22. The controller 22 will convert the direct current of the battery 24 into an alternating current to the ignition coil 20. As such, when the ignition coil 20 fires the spark plug 12, the spark will alternate between the electrodes 14 and 16 in accordance with the sine wave pattern of the alternating current. The battery 24 can be a conventional automotive battery, such as a twelve volt battery or a twenty-four volt battery.

Figure 2:
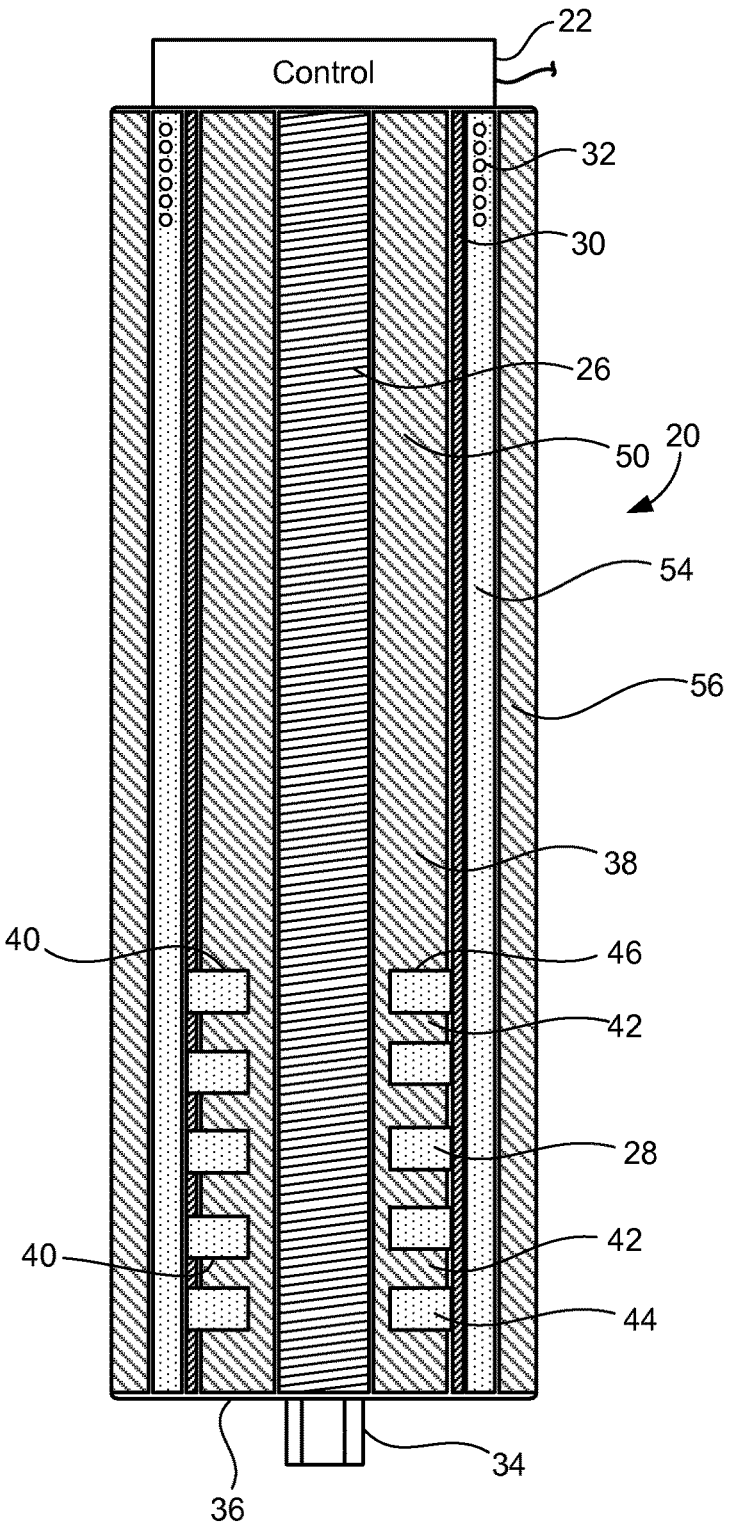
FIG. 2 is a cross-sectional view of the ignition coil in association with the present invention.

FIG. 2 shows the ignition coil 20 in accordance with the teachings of the present invention. The ignition coil 20 includes a core 26, a secondary winding 28, a sleeve 30, a primary winding 32 and the controller 22. A socket 34 is formed at the bottom 36 of the ignition coil 20 so as to directly connect the secondary winding 28 to the terminal 18 of the spark plug 12.

The core 26 extends longitudinally within the interior of the ignition coil 20. The secondary winding 28 extends around the core 26 and the primary winding 32 extends around the core 26. The core is preferably formed of a ferrite material. In particular, this ferrite material can be a powdered ferrite that is bonded with epoxy. The bonding of the ferrite core 26 with epoxy will enhance the ability of the core to work with high frequencies.

In FIG. 2, it can be seen that there is a bobbin 38 onto which the secondary winding 28 is received. The bobbin 38 includes a plurality of bays 40 formed thereon. The secondary winding 28 is positioned within these bays 40. Modern winding technology facilitates the ability to effectively wind the secondary 28 within the bays 40 of the bobbin 38. As such, the previously-described problems associated with prior bay-type bobbins is solved with modern winding technology. In effect, the secondary winding 28 can fill one bay and then move in an indexed manner to the next bay so that the secondary winding effectively fills all of the bays associated with the bobbin 38.

The arrangement of the bays 28 is a significant improvement over progressive winding technology. As stated hereinbefore, the problem with the progressive winding is the risk that the progressive winding will slip along the length of the bobbin during the manufacturing process. As such, the progressive winding may not be in the most desired position within the ignition coil. This can result in a failure or in adequate performance of the ignition coil. Since each of the bays 40 of the ignition coil 20 of the present invention are separated by flanges 42, these flanges will effectively retain the windings within the bays so as to assure that such slippage of the secondary winding will not occur.

In FIG. 2, it can be seen that the secondary winding 28 has a high-voltage end 44 and a low voltage end 46. The primary winding 32 is in spaced longitudinal relationship from the high-voltage end 44 of the secondary winding 28. The primary winding 32 is also longitudinally spaced from the low voltage end 46 of the secondary winding 28. Because of this separation, the primary winding 32 will be separated from the low voltage end 46 of the secondary winding 28 so that the problems associated with the deterioration of dielectrics is avoided. This avoids high-voltage flow through any dielectric material which could deteriorate the dielectric and result in an early failure of performance of the ignition coil.

In FIG. 2, the sleeve 30 will extend around the bobbin 34. Within the concept of the present invention, the primary winding 32 could extend over the upper portion 50 of the bobbin 38. In another embodiment, the bobbin 34 can have the portion 50 as a reduced diameter section and the sleeve 30 positioned over such a reduced diameter portion. As such, in the concept of the present invention, it is very important that the primary winding 32 be longitudinally spaced away from the low-voltage end 46 and the high-voltage end 44 of the secondary winding 28.

It can be seen in FIG. 2 that the primary winding 32 has six turns. The secondary winding 28 will have approximately 7,000 turns. As such, when the alternating current is applied by the controller 22 to the primary winding 32, the secondary winding 28 can produce 50,000 volts that for discharge through the socket 32 to the terminal of the spark plug.

A potting material 54 can be placed over the primary winding 32 and over the secondary winding 28. This potting material serves to fix the position of the windings and to prevent damage to the windings. The housing 56 can be placed over the potting material 54 so as to enclose the interior of the ignition coil 20. The controller 22 is positioned at a top of the housing 56.

Figure 3:
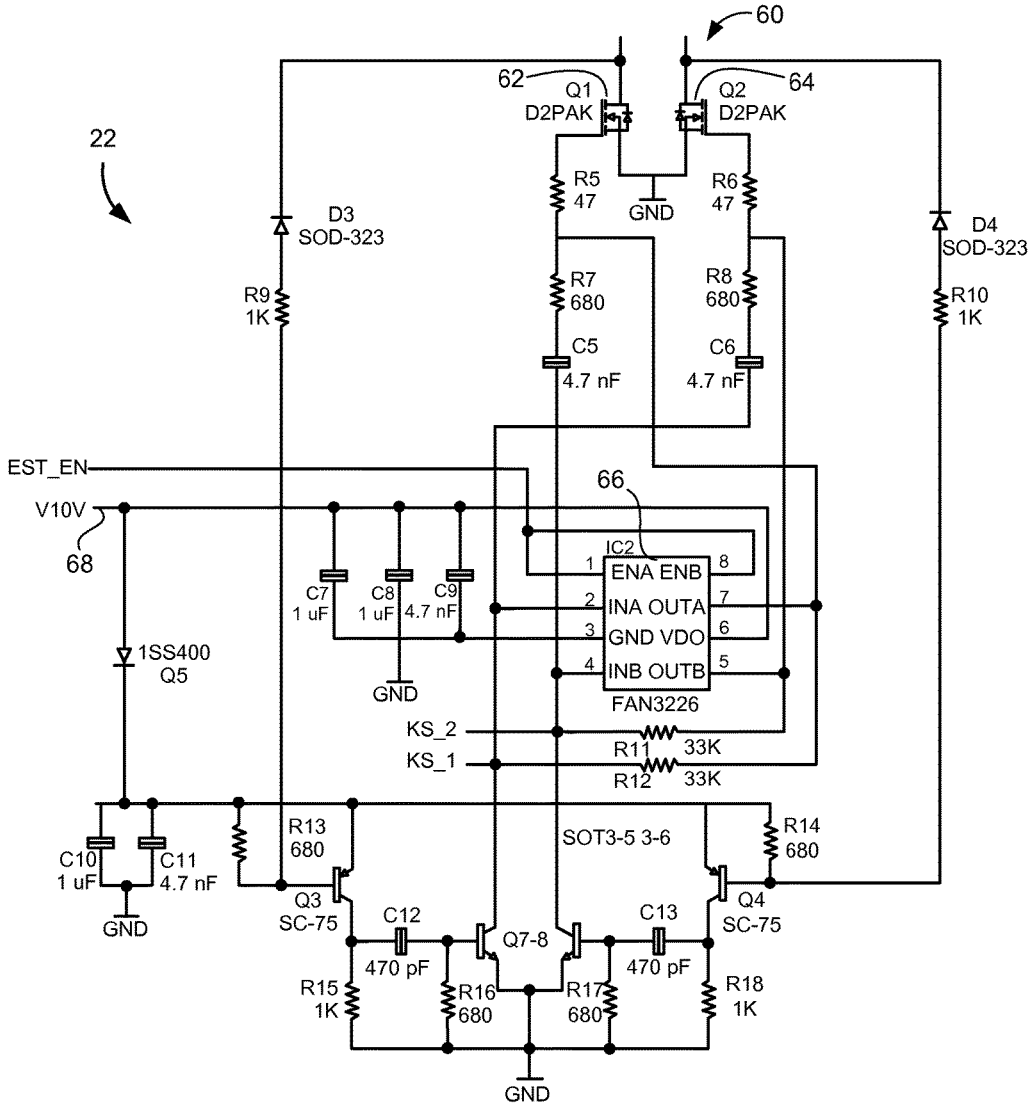
FIG. 3 is an electrical schematic showing the controller as used in the ignition system of the present invention.

FIG. 3 illustrates a schematic showing the controller 22. In particular, the controller 22 has an output 60 that is connected to the primary winding 32 of the ignition coil 20. Importantly, there are a pair of MOSFETs 62 and 64 that operate, in conjunction, so as to control the oscillating flow of alternating current to the primary winding 32. The MOSFET is a type of transistor that is used for amplifying or switching electronic signals. The MOSFET is a four-terminal device with a source terminal, a gate terminal, a drain terminal, and a body terminal. The body of the MOSFET is connected to the source terminal so as to make it a three-terminal device such as other field-effect transistors. Because these two terminals are normally connected to each other (short-circuited) internally, only three terminals appear in electrical diagrams. The MOSFET is preferred over a regular transistor in that it requires very little current to turn on (less than one mA), while delivering a much higher current to a load (10 to 50 A or more). As such, the MOSFETs 62 and 64 can serve to switch on the alternating current flow to the primary winding 32 so as to effectively fire the spark plug when fuel is directly injected into the cylinder. The MOSFETs 62 and 64 can remain in "on" condition for a fixed period of time by the integrated circuit 66 for the period of time desired for the burning of the fuel in the cylinder. As such, if the fuel-burning is to be for five milliseconds, then the one of the MOSFETs 62 and/or 64 can be turned on so as to effectively cause the spark from the spark plug to produce 50,000 volts for five milliseconds for the effective burning of the fuel. The integrated circuit 66 can include a clock so as to be connected to the engine management software such that the desired firing duration can be achieved. The integrated circuit 66 is connected to the battery at terminal 68 so as to effectively received the direct current from the battery. The circuitry shown in FIG. 3 can include suitable DC-to-AC conversion so that the MOSFETs 62 and 64 deliver alternating current to the primary winding to the primary winding 32.

The present invention provides a superior ignition coil for use in turbo-charged direct injection engines. Since these direct injection engines require fuel to be injected of a precise time, the controller 22 is adapted to fire the ignition coil, and the associated spark plug, at the precise time of fuel injection. The timing circuitry will cause the spark plug to remain at maximum power for the duration of the firing of the fuel. As such, the present invention provides a larger window with which to fire the fuel after it has been injected. This is particularly beneficial when diesel engines have been converted into natural gas-burning engines. The present invention provides a compact ignition coil for the limited space that is available in association with such conversions.

In the present invention, the high-voltage end 44 of the secondary winding 28 can transmit 50,000 volts. The primary 32 is located away from this secondary winding. As such, there will be no voltage between the primary winding in the secondary winding. In the past, this has been a troublesome spot since the dielectric between the high-voltage and the low-voltage can deteriorate over a period of time. The ferrite that is used for the core 26 is non-conductive. As such, once again, there is no voltage that is transmitted between the primary winding and the secondary winding. In other words, the 50,000 volts will not conducted through the core 26. As such, there is no need for insulation or dielectrics in association with the ignition coil 20 of the present invention. The ferrite core is used instead of a steel core (which can conduct).

The secondary winding 28 has, preferably, approximately 7000 turns. These turns are isolated in each of the bays 40. The bays provide a form which effectively holds the winding. Alternatively, the secondary windings 28 can be wound directly upon the core 26. Still further, and alternatively, the secondary winding 28 can be wound around a sleeve directly over the ferrite core 26.

When the bays 40 are used, the flanges 42 associated with these adjacent bays 40 serve to keep the secondary winding from sliding. This causes the winding process to be slower. However, this avoids the problems associated with the slippage of the winding that is associated with progressive windings.

The controller 22 provides proper oscillation, by way of the MOSFETs 62 and 64, so as to drive the power to the ignition coil. The oscillator takes the direct current (either 12 volts or 24 volts) with the MOSFETs 62 and 64 and serves to adjust the frequency of the resonance. Maximum amplitude is believed to be achieved at 30,000 Hertz. The arcing of the spark plug will occur at 90,000 Hertz. The circuitry effectively turns the direct current into an alternating current sine wave. As such, the present invention provides constant alternating current across the spark plug. The spark plug will have full power during the entire duration of the spot. The MOSFETs requires virtually no current or voltage in order to switch on and off.

The alternating of the current across the electrodes of the spark plug effectively avoids deterioration of the electrodes. Since the spark plug fires from a first electrode to a second electrode during a positive portion of the sine wave and fires from the second electrode to the first electrode during the negative part of sine wave, any deterioration of the electrodes is effectively avoided by this constant switching.

The resonance is achieved for maximum voltage. This maximum voltage occurs at 30,000 Hertz. If over 100,000 Hertz is achieved, then this could affect radio frequencies and, as a result, the quality of the radio performance. The resonance achieved by the oscillation of the alternating current provides the maximum amount of power from the minimal input.

Within the concept of the present invention, it is possible to pulse the alternating current during the firing of the spark plug. The pulsing of the alternating current allows for the fuel/air mixture to escape from the cylinder in a more uniform manner. It is possible that the fuel/air mixture could get hung up in the spark gap. Since a high frequency is generated in this gap, there is possibility that this high-frequency could contain the fuel/air mixture in this gap and somewhat negatively affect the escape of the completely burned fuel/air mixture. By the pulsing of the alternating current and the association of this pulsed alternating current with the electrodes of the spark plug, the gathering of the fuel/air mixture in the spark gap is effectively avoided.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An ignition coil comprising:

a core;

a bobbin positioned over and around said core, said bobbin having a plurality of bays formed adjacent only one end of said bobbin;

a secondary winding extending around said core, said secondary winding having a high-voltage end and a low-voltage end, said plurality of bays formed adjacent said high-voltage end of said secondary winding, said secondary winding having turns received in said plurality of bays;

a sleeve extending over said core and positioned so as to overlie said bobbin and said secondary winding;

a primary winding wrapped around an exterior of said sleeve, said primary winding spaced substantially longitudinally away from said low-voltage end of said secondary winding, said primary winding located longitudinally away from said high-voltage end of said secondary winding, said high-voltage end of said secondary winding being at a bay of said plurality of bays most distant from said primary winding; and a controller connected to said primary winding so as to oscillate alternating current to said primary winding.

2. The ignition coil of claim 1, said core being formed of a ferrite material.

3. The ignition coil of claim 1, said sleeve being integral with said bobbin.

4. The ignition coil of claim 1, said secondary winding having approximately 7000 turns, said primary winding having approximately 6 turns.

5. The ignition coil of claim 1, said high-voltage end of said secondary winding adapted to pass 50,000 volts outwardly thereof.

6. The ignition coil of claim 1, said controller having a MOSFET connected to said primary winding, said MOSFET adapted to oscillate the alternating current to said primary winding.

7. The ignition coil claim 6, said MOSFET passing the alternating current to said primary winding with a resonance of at least 30,000 Hertz and less than 100,000 Hertz.

8. The ignition coil of claim 2, said core being formed of a powdered ferrite material bonded with epoxy.

9. The ignition coil of claim 1, further comprising:

a power supply connected to said controller, said power supply being a direct current power supply, said controller converting the direct current power to the oscillating alternating current power.

10. The ignition coil claim 1, further comprising:

a socket connected to said high-voltage end of said secondary winding, said socket adapted to electrically connect with a terminal of a spark plug.

11. The ignition coil of claim 1, said controller affixed adjacent an end to said core opposite said high-voltage end of said secondary winding.

12. An ignition system comprising:

a direct current power supply;

a controller connected to said direct current power supply;

a core having a longitudinal axis;

a bobbin positioned over and around said core, said bobbin having a plurality of bays formed adjacent only one end of said bobbin;

a secondary winding extending around said core and received in said plurality of bays, said secondary winding having a high-voltage end adjacent said only one end of said bobbin and a low-voltage end away from said high-voltage end;

a sleeve overlying said bobbin and said core, said primary winding wrapped around said sleeve and located substantially longitudinally away from said high-voltage end of said secondary winding; and a spark plug connected to said high-voltage end of said secondary winding.

13. The ignition system of claim 12, said secondary winding having approximately 7000 turns, said primary winding having approximately 6 turns, said high-voltage end of said secondary winding adapted to pass 50,000 volts outwardly thereof.

14. The ignition system of claim 12, said controller have a MOSFET connected to said primary winding, said MOSFET adapted oscillate the alternating current to said primary winding.

15. The ignition system of claim 14, said MOSFET passing the alternating current to said primary winding with a resonance of at least 30,000 Hertz and less than 100,000 Hertz.

* * * * *